US007969458B2

(12) United States Patent
Yamade

(10) Patent No.: US 7,969,458 B2
(45) Date of Patent: Jun. 28, 2011

(54) THERMAL PRINTHEAD

(75) Inventor: Takumi Yamade, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 12/376,384

(22) PCT Filed: Jul. 26, 2007

(86) PCT No.: PCT/JP2007/064663

§ 371 (c)(1),
(2), (4) Date: Jul. 19, 2010

(87) PCT Pub. No.: WO2008/015958

PCT Pub. Date: Feb. 7, 2008

(65) Prior Publication Data

US 2010/0289862 A1 Nov. 18, 2010

(30) Foreign Application Priority Data

Aug. 4, 2006 (JP) ..... 2006-212851

(51) Int. Cl.
*B41J 2/335* (2006.01)

(52) U.S. Cl. ..... 347/203

(58) Field of Classification Search ..... 347/200, 347/203

See application file for complete search history.

(56) References Cited

U.S. PATENT DOCUMENTS 5,099,257 A * 3/1992 Nakazawa et al. ..... 347/201
5,157,414 A * 10/1992 Seino et al. ..... 347/207
6,441,840 B1 8/2002 Sato et al.

FOREIGN PATENT DOCUMENTS

| | | |
|---|---|---|
| JP | 62-62775 | 3/1987 |
| JP | 1-244870 | 9/1989 |
| JP | 2002-2005 | 1/2002 |
| JP | 2006-1017 | 1/2006 |

* cited by examiner

*Primary Examiner* — Huan H Tran

(74) *Attorney, Agent, or Firm* — Hamre, Schumann, Mueller & Larson, P.C.

(57) ABSTRACT

A thermal printhead (A1) includes a substrate (1) and a heating resistor (3) supported by the substrate (1). An electrode pattern (2) is formed in contact with the heating resistor (3) for applying driving voltage. The heating resistor (3) is covered with a protective film (5). The protective film (5) includes a high thermal conductivity layer (51) and a low thermal conductivity layer (52) laminated on the high thermal conductivity layer. The low thermal conductivity layer (52) is positioned farther from the heating resistor (3) than the high thermal conductivity layer (51) is.

6 Claims, 4 Drawing Sheets

THERMAL PRINTHEAD

TECHNICAL FIELD

The present invention relates to a thermal printhead incorporated in a thermal printer.

BACKGROUND ART

A thermal printhead includes an insulating substrate and a heating resistor formed on the substrate. In printing, current is applied to the heating resistor, whereby images or letters are formed on a recording medium such as thermal paper (see Patent Document 1 below).

FIG. 5 is a partial sectional view showing an example of conventional thermal printhead. The thermal printhead X shown in the figure includes a substrate 91 and a partial glaze 92 elongated in the primary scanning direction. A plurality of electrodes 93 extending in the secondary scanning direction are provided on the substrate 91. A heating resistor 94 extending across the electrodes 93 (i.e., in the primary scanning direction) is provided on the partial glaze 92. A protective film 95 for protecting the heating resistor 94 and other parts is provided on the substrate 91. In printing, thermal paper is transferred in the secondary scanning direction while being pressed against the protective film 95.

Sticking (the phenomenon in which a recording medium sticks to a printhead) is a conventionally known problem which often occurs in a thermal printhead. To prevent sticking in the above-described printhead X, it is necessary to form the protective film 95 properly. The provision of the proper protective film 95 is also necessary for increasing the printing speed.

For instance, to make the protective film 95 using a material having a high thermal conductivity may be considered to be an effective way to increase the printing speed. With such a protective film, the thermal paper is heated and cooled quickly, so that the printing speed is expected to increase.

However, the rapid temperature change of the thermal paper is not suitable for preventing the sticking. Specifically, a resin material for fixing a heat-sensitive material is applied to the thermal paper. When the resin material is suddenly cooled after melted due to the temperature rise, the thermal paper tends to adhere to the protective film 95.

Patent Document 1: JP-A-2002-2005

DISCLOSURE OF THE INVENTION

The present invention has been proposed under the circumstances described above. It is, therefore, an object of the present invention to provide a thermal printhead which is capable of preventing sticking while maintaining proper printing speed.

According to a first aspect of the present invention, there is provided a thermal printhead that comprises a substrate, a heating resistor formed on the substrate, an electrode for applying current to the heating resistor, and a protective film covering the heating resistor. The protective film includes a high thermal conductivity portion and a low thermal conductivity portion having a lower thermal conductivity than the high thermal conductivity portion. The low thermal conductivity portion is positioned farther from the heating resistor than the high thermal conductivity portion is.

With the above-described arrangement, the overall heat transfer coefficient of the protective film is adjusted as desired by appropriately setting the thickness of the high thermal conductivity portion and the low thermal conductivity portion. Thus, the degree of temperature rise and temperature drop of a recording medium such as thermal paper can be adjusted properly, so that the sticking is prevented while the printing speed is maintained.

In a preferred embodiment of the present invention, the protective film includes a high thermal conductivity layer and a low thermal conductivity layer laminated on the high thermal conductivity layer. The low thermal conductivity layer is made of a material having a lower thermal conductivity than the material of the high thermal conductivity layer. Further, the low thermal conductivity layer is positioned farther from the heating resistor than the high thermal conductivity layer is.

Preferably, the high thermal conductivity layer is made of SiC, SiN or Sialon, and the low thermal conductivity layer is made of TaN.

Preferably, the thermal conductivity of the protective film becomes lower as proceeding away from the heating resistor in the thickness direction of the protective film.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
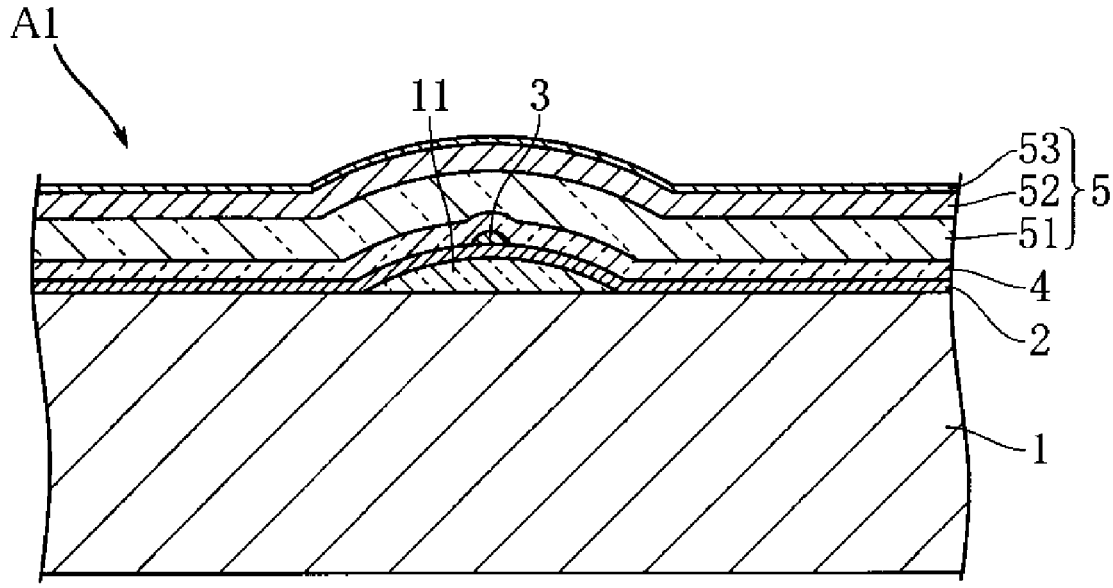
FIG. 1 is a sectional view showing a principal portion of a thermal printhead according to a first embodiment of the present invention.
Figure 2:
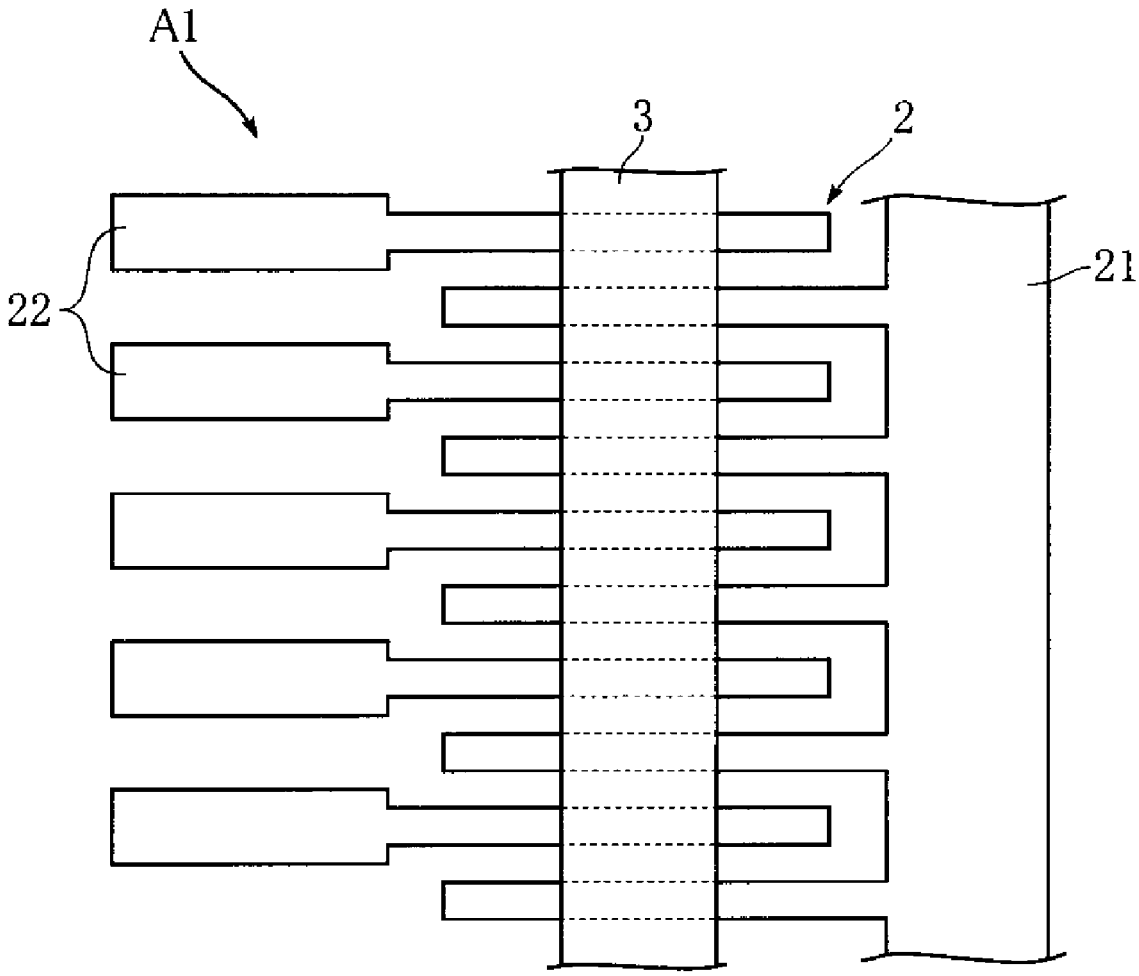
FIG. 2 is a plan view showing the principal portion of the thermal printhead according to the first embodiment.

FIGS. 1 and 2 show a thermal printhead according to a first embodiment of the present invention. The illustrated thermal printhead A1 includes a substrate 1, an electrode pattern 2, a heating resistor 3, a glass layer 4 and a protective film 5. It is to be noted that only the electrode pattern 2 and the heating resistor 3 are shown in FIG. 2.

The substrate 1 comprises an insulating substrate which is rectangular in plan view and elongated in the primary scanning direction. The substrate is made of e.g. alumina ceramic material. A partial glaze 11 is formed on the upper surface of the substrate 1. The partial glaze 11 is in the form of a strip extending in the primary scanning direction. As will be understood from the sectional view of FIG. 1, the partial glaze 11 bulges in the thickness direction of the substrate 1.

The electrode pattern 2 is provided for applying current to the heating resistor 3 and includes a common electrode 21 and a plurality of individual electrodes 22. The common electrode 21 comprises a strip portion extending in the primary scanning direction and a plurality of comb-tooth portions extending in the secondary scanning direction. The ends of the individual electrodes 22 and the comb-tooth portions of the common electrode are alternately arranged in the primary scanning direction. For instance, the electrode pattern 2 is formed by thick film printing of resinate Au paste and the subsequent baking of the paste.

The heating resistor 3 is a heat generating source of the thermal printhead A1. The heating resistor 3 is in the form of a strip elongated in the primary scanning direction and extends across the comb-tooth portions of the common electrode 21 and ends of the individual electrodes 22. When current is applied to a portion of the heating resistor 3 via the common electrode 21 and a selected one of the individual electrodes 22, the portion is heated. For instance, the heating resistor 3 is formed by thick film printing of ruthenium oxide paste and the subsequent baking of the paste.

As shown in FIG. 1, the glass layer 4 covers the partial glaze 11, the electrode pattern 2 and the heating resistor 3. For instance, the glass layer 4 is formed by thick film printing of glass paste and the subsequent baking of the paste. In this embodiment, the glass layer 4 has a thickness of about 6.0 μm.

The protective film 5 is formed on the glass layer 4 and covers the heating resistor 3 via the glass layer 4. As shown in FIG. 1, the protective layer 5 comprises a first layer 51 having a relatively high thermal conductivity, a second layer 52 having a relatively low thermal conductivity, and a third layer 53 made of a hard material. The first layer 51 is made of e.g. SiC and has a thickness of about 3.0 μm. The thermal conductivity of the second layer 52 is lower than that of the first layer 51. The second layer 52 is made of e.g. TaN and has a thickness of about 0.8 μm. The third layer 52 is made of e.g. electrically conductive Sialon and has a thickness of about 0.2 μm. The third layer 53 is made of a very hard material, so that it is not damaged due to contact with thermal paper, although the thickness is relatively small. For instance, the first layer 51, the second layer 52, the third layer 53 are formed by sputtering.

The advantages of the thermal printhead A1 will be described below.

With the above-described structure, the degree of temperature rise and temperature drop of a recording medium such as thermal paper during the printing operation by the thermal printhead A1 is properly adjusted. Specifically, the overall heat transfer coefficient of the entirety of the protective film 5 is determined by the thermal conductivities and thicknesses of the first layer 51, the second layer 52 and the third layer 53. Particularly, the first layer 51 having a relatively large thickness and the second layer 52 having a low thermal conductivity are the main factors which determine the overall heat transfer coefficient. Thus, by appropriately setting the thicknesses of the first layer 51 and the second layer 52, the overall heat transfer coefficient is adjusted as desired. For instance, the overall heat transfer coefficient can be increased by increasing the thickness of the first layer 51.

When the temperature of the thermal paper rises or drops too rapidly, the thermal paper tends to adhere to the protective film 5. According to this embodiment, however, by properly setting the thicknesses of the first layer 51 and the second layer 52, sticking is prevented without reducing the printing speed. According to the studies performed by the inventors of the present invention, sticking is more reliably prevented when the second layer 52 is made of TaN.

Figure 3:
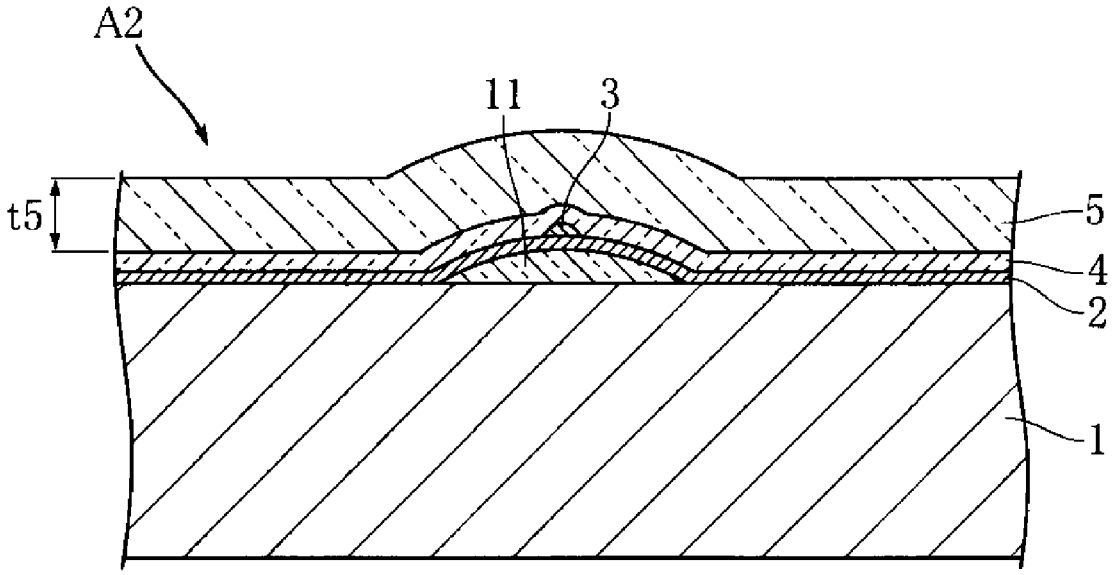
FIG. 3 is a sectional view showing a principal portion of a thermal printhead according to a second embodiment of the present invention.

FIG. 3 shows a thermal printhead A2 according to a second embodiment of the present invention. The thermal printhead A2 differs from the thermal printhead A1 in structure of the protective film 5. In this figure, the elements of the second embodiment which are identical or similar to those of the first embodiment are designated by the same reference signs as those used for the first embodiment.

Figure 4:
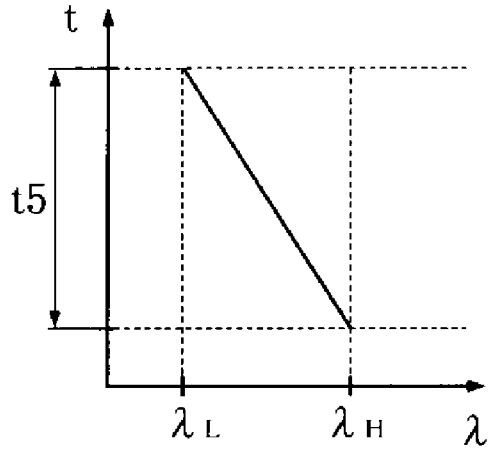
FIG. 4 is a graph showing the relationship between the position in the protective film in the thickness direction and the thermal conductivity in the thermal printhead of the second embodiment.
Figure 5:
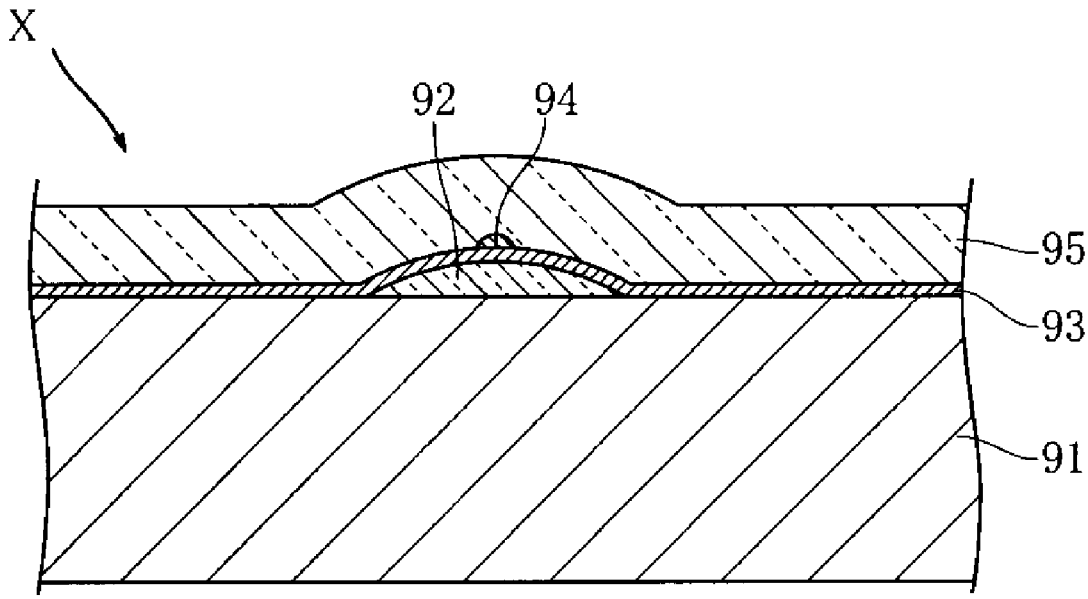
FIG.5 PRIOR ART
FIG. 5 is a sectional view showing a principal portion of a conventional thermal printhead.

The protective film 5 of the thermal printhead A2 comprises a single layer made of e.g. SiC. The thickness t5 of the protective film 5 is about 4.0 μm. The protective film 5 is so designed that the position in the thickness direction and the thermal conductivity λ has the relationship shown in FIG. 4. The vertical axis of the graph of FIG. 4 indicates the position t in the protective film 5 in the thickness direction (upward direction in FIG. 3), and the value t increases as proceeding away from the heating resistor 3. Of the protective film 5, the portion which is closest to the heating resistor 3 has a relatively high thermal conductivity $\lambda_H$ (high thermal conductivity portion). Of the protective film 5, the portion which is farthest from the heating resistor 3 has a relatively low thermal conductivity $\lambda_L$ ($\lambda_L<\lambda_H$) (low thermal conductivity portion). In the protective film 5, the position in the thickness direction and the thermal conductivity λ have a linear relationship. For instance, such a protective film 5 can be formed by sputtering. In this case, the gas pressure is gradually increased from the start to the end of the film formation process.

According to the second embodiment again, the degree of temperature rise and temperature drop of thermal paper is properly adjusted. Thus, the second embodiment has the same advantages as those of the first embodiment. Further, since the protective film 5 comprises a single layer, the protective film does not partially peel off.

The invention claimed is:

1. A thermal printhead comprising:

a substrate;

a heating resistor supported by the substrate;

an electrode for applying current to the heating resistor; and a protective film covering the heating resistor;

wherein the protective film includes a higher thermal conductivity layer and a lower thermal conductivity layer laminated on the higher thermal conductivity layer, the lower thermal conductivity layer is made of a material having a lower thermal conductivity than a material of the higher thermal conductivity layer, and the lower thermal conductivity layer is positioned farther from the heating resistor than the higher thermal conductivity layer is; and wherein the higher thermal conductivity layer is made of one of SiC, SiN and Sialon, and the lower thermal conductivity layer is made of TaN.

2. The thermal printhead according to claim 1, further comprising a glass layer between the heating resistor and the protective film.

3. The thermal printhead according to claim 2, wherein the protective film further includes an outermost layer covering the lower thermal conductivity layer and made of Sialon.

4. A thermal printhead comprising:

a substrate;

a heating resistor supported by the substrate;

an electrode for applying current to the heating resistor; and a protective film covering the heating resistor;

wherein the protective film includes a higher thermal conductivity portion and a lower thermal conductivity portion having a lower thermal conductivity than the higher thermal conductivity portion, and the lower thermal conductivity portion is positioned farther from the heating resistor than the higher thermal conductivity portion is; and wherein the protective film includes only a single layer whose thermal conductivity becomes progressively lower with increasing distance from the heating resistor in a thickness direction within the single layer.

5. The thermal printhead according to claim 4, wherein the thermal conductivity of the single layer of the protective film decreases linearly with increasing distance from the heating resistor in the thickness direction within the single layer.

6. The thermal printhead according to claim 4, wherein the single layer of the protective film is made of SiC.

* * * * *